US007717831B2

(12) United States Patent
Giannelli

(10) Patent No.: US 7,717,831 B2
(45) **Date of Patent: *May 18, 2010**

(54) TORSO EXERCISE MACHINE

(75) Inventor: Raymond Giannelli, Franklin, MA (US)

(73) Assignee: Cybex International, Inc., Medway, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/051,976

(22) Filed: Mar. 20, 2008

(65) Prior Publication Data

US 2008/0167169 A1 Jul. 10, 2008

Related U.S. Application Data

(63) Continuation of application No. 10/293,042, filed on Nov. 13, 2002, now abandoned.

(60) Provisional application No. 60/338,039, filed on Nov. 13, 2001.

(51) Int. Cl.
*A63B 21/08* (2006.01)

(52) U.S. Cl. ..... 482/97; 482/92

(58) Field of Classification Search ..... 482/92–100, 482/142, 148, 907, 91

See application file for complete search history.

(56) References Cited

U.S. PATENT DOCUMENTS

| | | | | |
|---|---|---|---|---|
| 4,500,089 | A | 2/1985 | Jones | |
| 4,666,152 | A | 5/1987 | Jones | |
| 4,836,536 | A | 6/1989 | Jones | |
| 5,549,534 | A | 8/1996 | Parviainen | |
| 5,554,086 | A * | 9/1996 | Habing et al. | 482/137 |
| 5,597,375 | A | 1/1997 | Simonson | |
| 5,722,917 | A * | 3/1998 | Olschansky et al. | 482/72 |
| 6,015,372 | A | 1/2000 | Steffee et al. | |
| 6,059,701 | A * | 5/2000 | George et al. | 482/137 |
| 6,213,438 | B1 | 4/2001 | Ostby et al. | |
| 6,354,982 | B1 | 3/2002 | Sencil | |
| 6,361,482 | B1 * | 3/2002 | Batca et al. | 482/100 |
| 6,676,573 | B2 * | 1/2004 | Abelbeck et al. | 482/95 |
| 6,719,672 | B1 | 4/2004 | Ellis et al. | |
| 6,752,748 | B1 * | 6/2004 | Scotti | 482/140 |
| 2002/0022556 | A1 | 2/2002 | Eriksson et al. | |
| 2002/0128124 | A1 | 9/2002 | Mosimann et al. | |
| 2003/0092540 | A1 * | 5/2003 | Gillen | 482/99 |
| 2007/0037673 | A1 * | 2/2007 | Giannelli et al. | 482/95 |

* cited by examiner

*Primary Examiner*—Lori Baker
(74) *Attorney, Agent, or Firm*—Rissman, Hendricks & Oliverio, LLP

(57) ABSTRACT

The subject invention provides an exercise machine for exercising the lower torso. As described herein, the exercise machine includes a stabilizer pad, which effectively immobilizes the user's lower body to maintain proper pelvic positioning during execution of the exercise. The stabilizer pad can be part of a user support structure having a seat surface, a pelvic stabilizer pad and a footrest. The footrest is positioned so the user can apply a force using the leg muscles to push the pelvis into the pelvic stabilization pad. The spatial arrangement of the stabilization assembly which comprises: pelvic stabilizer pad, seat, and footrest combination effectively immobilize the user's pelvic area, preventing it from rotating in either the anterior or posterior direction.

12 Claims, 5 Drawing Sheets

TORSO EXERCISE MACHINE

CROSS-REFERENCE TO RELATED APPLICATION

This application is a continuation of and claims the benefit of priority to U.S. patent application Ser. No. 10/293,042, filed Nov. 13, 2002 which claims priority to U.S. Provisional Application Ser. No. 60/338,039, filed Nov. 13, 2001, entitled TORSO EXERCISE MACHINE, the entirety of the disclosures of all of the foregoing applications of are incorporated herein by reference.

STATEMENT REGARDING FEDERALLY SPONSORED RESEARCH OR DEVELOPMENT n/a

FIELD OF THE INVENTION

The present invention relates to a method and system for exercising the lower torso, and more particularly to an exercise machine which includes a stabilizer assembly to effectively immobilize the user's lower body, maintaining proper pelvic positioning and stabilization during execution of the exercise.

BACKGROUND OF THE INVENTION

Proper form is essential for effective and safe results when performing resistive exercises such as with weight machines used for strength training. This is especially true for exercise of the muscle groups found in the torso during spinal extention and spinal flexion exercises, as it is known in the art. This exercise motion focuses on training the lower back muscles, the abdominals, and obliques. Too often however, the various machines and devices available for this purpose lack proper features to ensure that users execute a safe and effective motion thereupon to exercise the back or abdominal muscles.

Many torso exercise machines use a conventional cable and pulley system coupled to a weight stack. A user typically sits on a stationary surface, and then applies his or her upper body against another surface. A user may then apply force on this latter surface whilst rotating the torso about the base of the spine, to either: (a) flex the spine by contracting the abdominal muscles so as to train the abdominal muscles group, or (b) extend the spine by contracting the back muscles so as to train the muscles of the central and lower back. To achieve this range of motion, a user's hips are often unsecured, and may be free to move or shift while the exercise is performed. This allows other skeletal motions such as hip flexion to substitute for spinal flexion and conversely hip extension to substitute for spinal extention. When that is allowed to happen, the user will be exercising the hip and not the abdominals and back musculature. Some torso exercise machines may use a back support to try to limit the extent of spinal extention range especially in the lumbar region of the spine but unless there is some significant force holding the back against this back support, they are traditionally ineffective at stabilizing the pelvis and preventing hip flexion/extention substitution.

It is desirable therefore, to provide a weight training machine which allows a user to exercise his or her muscles in the torso region, while sufficiently stabilizing the pelvis to effectively block hip motion and substitution and focus the training effect on the intended muscles of the abdomen and lower back.

SUMMARY OF THE INVENTION

The subject invention provides an exercise machine for exercising the lower torso. As described herein, the exercise machine includes a pelvic stabilizer assembly, which effectively immobilizes the user's lower body to maintain proper pelvic positioning during execution of the exercise.

For example, the exercise machine of the present invention could be a back extension machine, which includes a user support structure is mounted on the support frame. The user support structure includes a seat surface and a pelvic stabilizer pad. The seat is mounted on a forwardly facing angled upper portion of the support frame, below and at an angle oblique to the pelvic stabilizer pad. The seat is positioned such that the user's lower back and pelvic region abuts the pelvic stabilizer pad and the user's legs extend outwardly and downwardly. The pelvic pad is affixed to the upper end of the support frame and is inclined rearwardly, and being curved in a substantially half-cylindrical shape, to accommodate the user's lower back at full extension.

In addition to the pelvic stabilization pad, the stabilization assembly includes an adjustable footrest is attached to the front of the support frame, such that a user's feet are positioned on the footrest. The footrest can be adjusted back and forth with the footrest adjustment mechanism to accommodate users of varying heights. The footrest is positioned so the user can apply a force using the leg muscles to push the pelvis into the pelvic stabilization pad. The spatial arrangement of the stabilization assembly which comprises: pelvic stabilizer pad, seat, and footrest combination effectively immobilize the user's pelvic area, preventing it from rotating in either the anterior or posterior direction while not interfering with the normal range of motion in extention and flexion of the spine.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
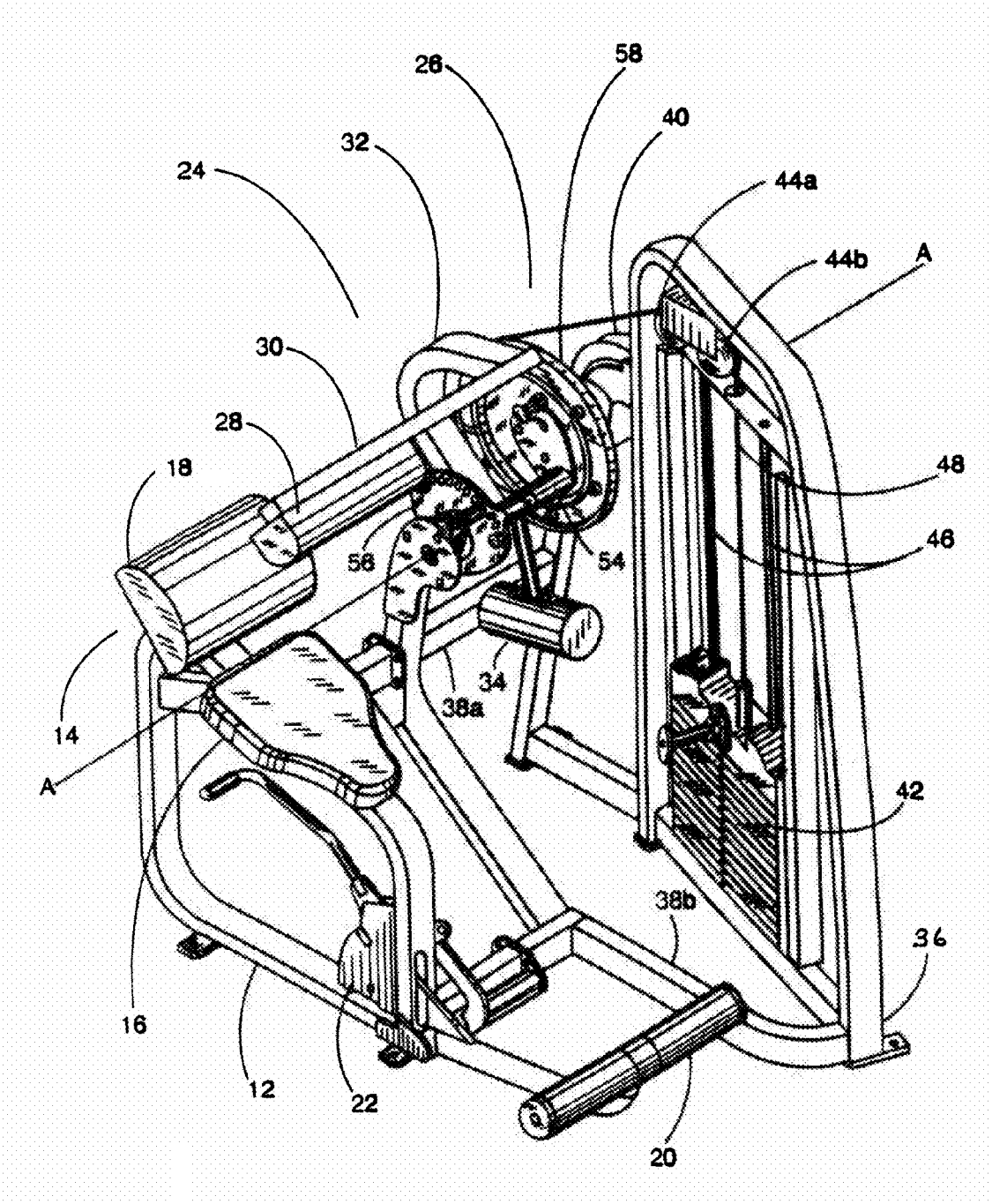
FIG. 1 is a perspective view of a back extension machine of the subject invention.

In an exemplary embodiment, as shown in FIG. 1, a back extension machine 10 of the present invention includes a support frame 12 on which a user support structure 14 is mounted. The user support structure 14 includes a seat surface 16 and a pelvic stabilizer pad 18. The seat 16 is mounted on the forwardly facing angled upper portion of the support frame 12, below and at an angle oblique to the pelvic stabilizer pad 18. The seat 16 is positioned such that the user's lower back and pelvic region abuts the pelvic stabilizer pad 18 and the user's legs extend outwardly and downwardly. The pelvic stabilizer pad 18 is affixed to the upper end of the support frame 12, is inclined rearwardly, and is curved in a substantially half-cylindrical shape to accommodate for the user's lower back.

An adjustable footrest 20 is attached to the front of the support frame 12, where the oblique angle of the seat 16 substantially directs the seat 16 down towards footrest 20. The footrest 20 is positioned so the user can apply a force using the leg muscles to push the pelvis into the pelvic stabilization pad 18. The footrest 20 can be adjusted back and forth with the footrest adjustment mechanism 22 to accommodate users of varying heights. When a user's feet are positioned on the footrest 20, the footrest is adjusted such that the users thighs are substantially parallel with the ground. Additionally, the user's knees are in a flexion position of between about 10 degrees knee flexion to about 30 degrees knee flexion. This spatial arrangement of the pelvic stabilizer pad 18, seat 16, and footrest 20 combination effectively immobilize the user's pelvic area, preventing it from rotating in either the anterior or posterior direction.

An input assembly 24 is positioned above of the seat 16, and mounted to the support frame 12 for rotation about a horizontal axis A-A, as defined by the range-limiting device 26, described in further detail below. The input assembly 24 includes a padded member 28 affixed to a horizontal arm 30, where the padded member 28 is positioned for engagement of a user's upper back. The horizontal arm 30 is attached to a curved offset arm 32, where the curved offset arm 32 is affixed to the range-limiting device 26, such that the padded member 28 is positioned above the seat 16. A counterweight 34 is attached to the range-limiting device 26 to balance the input assembly 24 about the horizontal axis A-A.

A weight stack brace 36 is attached to the support frame 12 by beams 38*a* and 38*b* and secondary support frame 40, such that the weight stack 42 is easily accessed by a seated user. Weight stack pulleys 44*a* and 44*b* are mounted to the top of the weight stack brace 36, with pulley 44*a* being aligned with the start-positioning device 26 and pulley 44*b* being aligned with the weight stack 42. Rails 46 are mounted vertically within the weight stack brace 36, where the individual plates of the weight stack 42 are slideably mounted to the rails 46 and provide a resistance to the exercise.

The weight stack 42 is selectively connected to one end of a cable 48 by inserting a pin in one of a plurality of holes in a lifting post 50 that passes vertically through the plates, as is well known in the art. For example, the weight stack 42 is formed by a stack of rectangular, brick-shaped plates 52. Each plate 52 further has at least one horizontal channel or hole, wherein a pin may be disposed to slideably engage any of a series of horizontal channels which are vertically oriented on the lifting post 50 in a spaced apart manner to match the vertical spacing of the stacked weight plates 52. The pin thereby engages a portion of the stack of weight plates 52, such that when vertical force is applied to the lifting post 50, the selected stack of weight plates 52 is moved upwards to create a resistance. Typically, the weight stack 42 apparatus is oriented such that the further down the pin is entered into the lifting post 50, the greater the number of plates 52 are engaged, thereby increasing the resistance of the machine.

The cable 48 extends up from the weight stack 42 and a portion of cable 48 extends over pulleys 44*a* and 44*b*. The second end of the cable 48 is connected to the start-positioning device 58, thereby inhibiting rotation of the start-positioning device.

Additionally, the weight stack 42 can be connected to the start-positioning device 58 by other means known in the art, including, but not limited to, belts, cables, chains, or tethers, so as to inhibit rotation thereof.

In alternative embodiments, other mechanisms for providing resistance, such as friction fittings, springs, elastic bands, pneumatic or electromagnetic resistance, or an air resistance fan could be employed (either alone or in combination) and still practice the invention. Additionally, free weights could be operably engaged to the transmission assembly to resist the movement.

Figure 2:
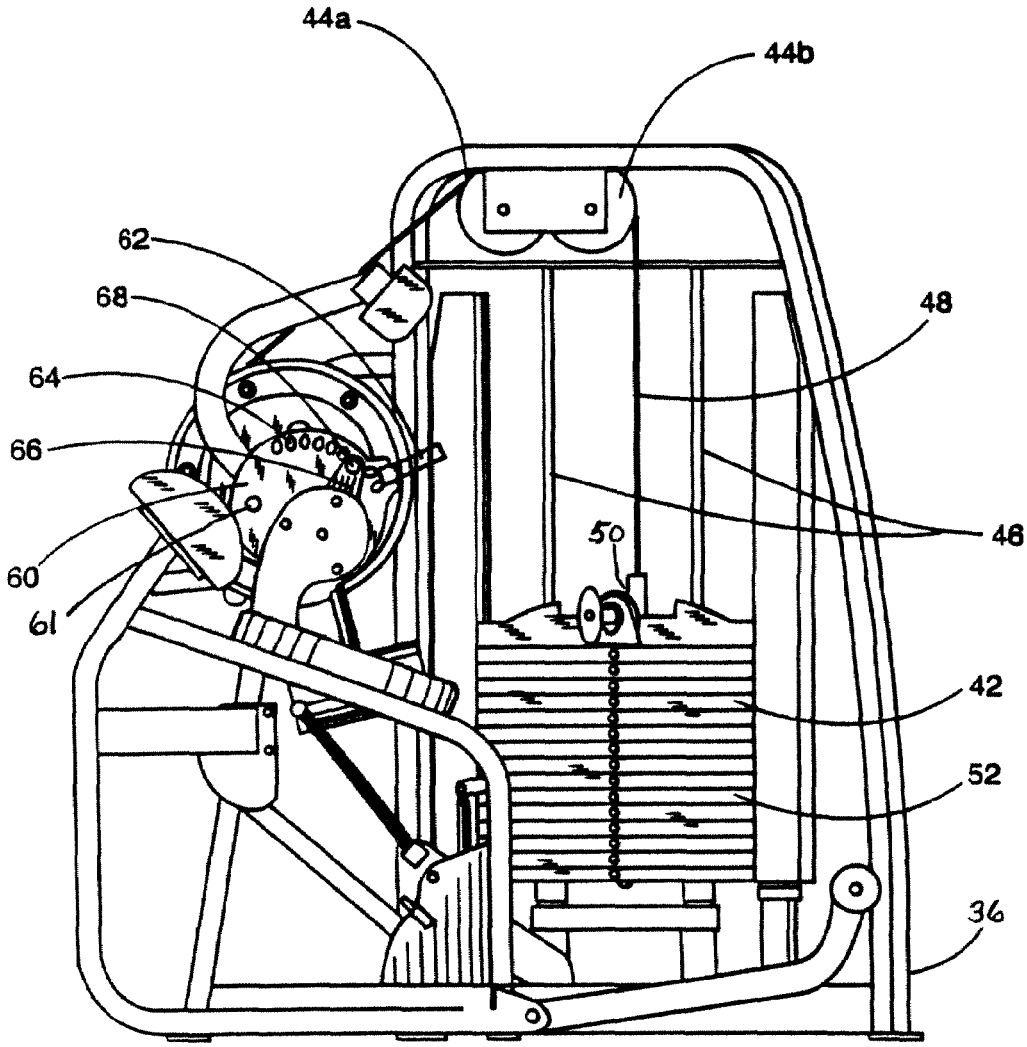
FIG. 2 is a side view of a back extension machine of the subject invention.

As shown in FIG. 1, the range-limiting device 26 includes a horizontal shaft 54, defining the horizontal axis of rotation A-A, the horizontal shaft 54 being pivotally connected to the support frame 22 and the secondary support frame 40. An end-positioning device 56 and a start-positioning device 58 are affixed to the horizontal shaft 54. The end-positioning device 56 includes a detent plate 60 having a horizontal stop 61, a handle element 62, and defining a plurality adjustment holes 64. (See also FIG. 2). The detent plate 60 is rotatably affixed about the horizontal shaft 54 and affixable to the support frame's stop arm 66 by the engagement of stop pin 68 to one of the detent plate's adjustment holes 64. The detent plate's vertical stop 61 is positioned for engagement of the curved offset arm 32, where the horizontal stop 84 limits the angle of rotation of the input assembly 24.

Figure 3:
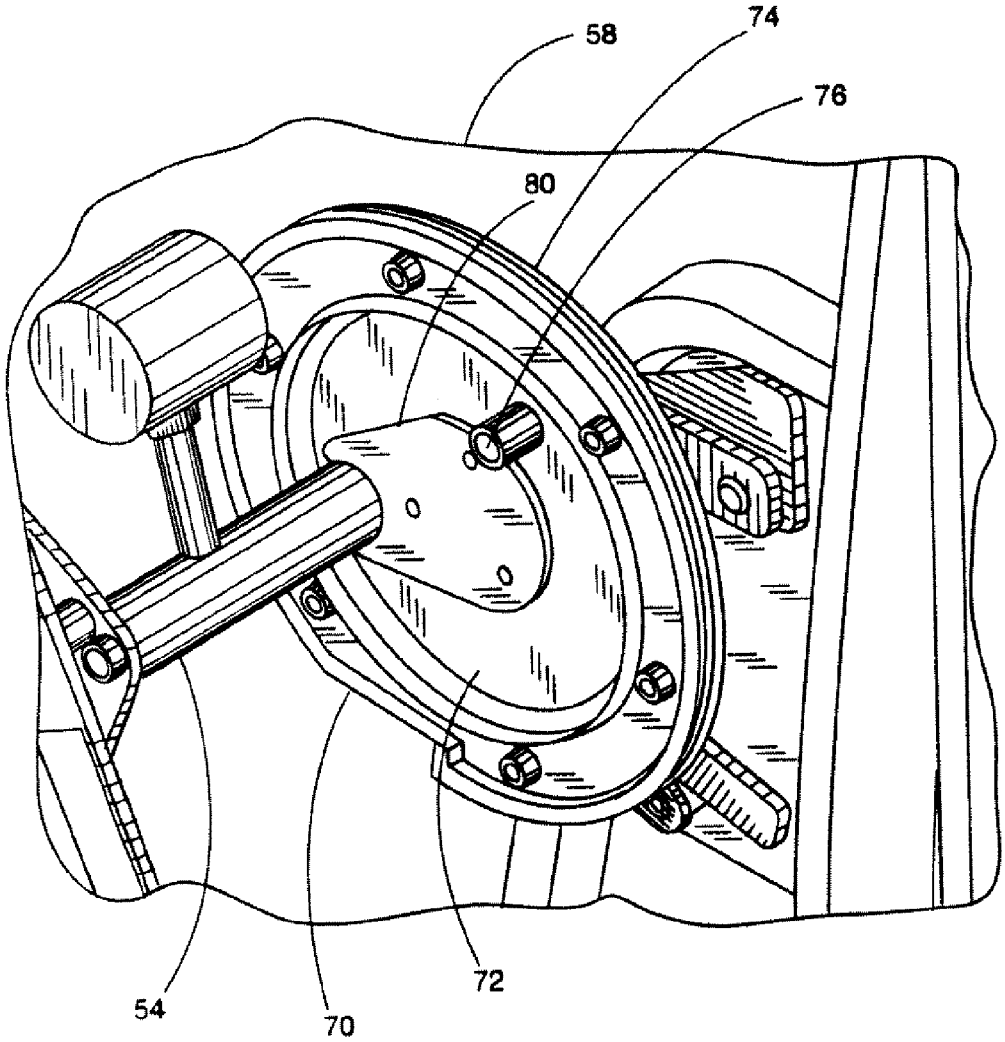
FIG. 3 is a left side perspective view of the start-positioning device of the subject invention.
Figure 4:
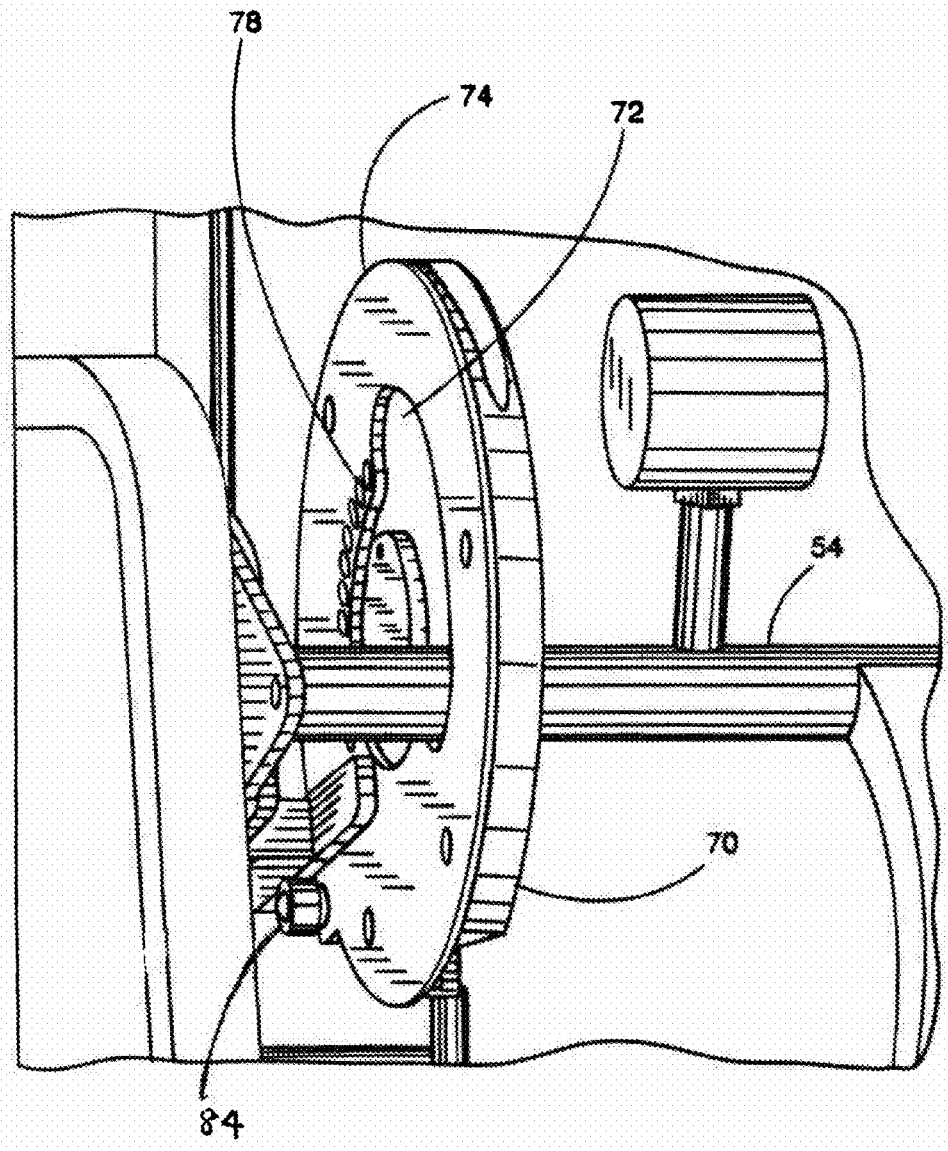
FIG. 4 is a right side perspective view of the start-positioning device of the subject invention.

As shown in FIGS. 3 and 4, the start-positioning device 58 is affixed to the horizontal shaft 54, and includes a cam 70, eccentric plate 72, and a cam plate 74. The cam 70 is configured to receive the eccentric plate 72, such that the eccentric plate 72 is rotatable within the cam 70. The cam plate 74 is attached to the cam 70, sealing the eccentric plate 72 within the cam 70, such that the cam 70 and cam plate 74 are rotatable about the eccentric plate 72. The eccentric plate 72 includes a cam pin 76 for engaging the cam plate's adjustment holes 78. The eccentric plate 72 is attached to the horizontal shaft's offset mounting arm 80, such the axis of rotation of the eccentric plate 72 is offset from the eccentric plate's central axis.

As noted above, the eccentric plate 72 is attached to the horizontal shaft's offset mounting arm 80, such the axis of rotation of the eccentric plate 72 is offset from the eccentric plate's central axis. Accordingly, as the eccentric plate 72 rotates within the cam 70, the radial positioning of the cam 70 about the horizontal shaft 54 is changed, changing the effective radius of curvature of the cam 70 with respect to the input assembly 24. The automatic change in the effective radius of curvature of the cam 70 provides an automatic change in the mechanical advantage over the adjusted range of motion, thus providing the correct anatomical mechanical advantage for the adjusted range of motion.

In an exemplary method of use, the end-positioning device 56 and the start-positioning device 58 are used in conjunction to adjust the exercise start and stop positions. Initially, the user adjusts the start position as noted above. In doing so, the effective radius of curvature of the cam 70 is changed, providing the appropriated mechanical advantage for the new start position. The user can then adjust the stop position as noted above, thereby provided a limited range of motion for the exercise.

Figure 5:
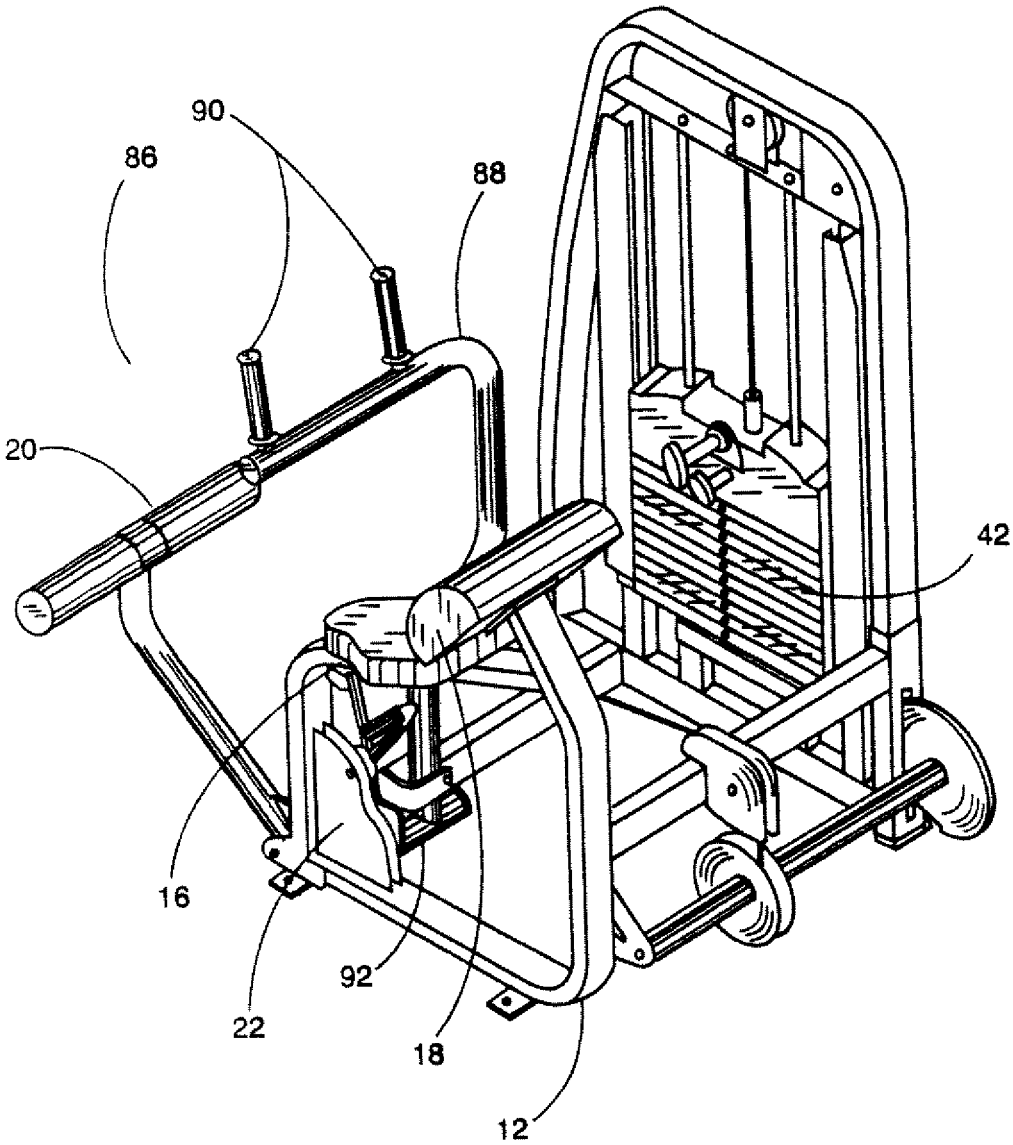
FIG. 5 is a perspective view of an abdominal machine in accordance with the invention.

Referring now to FIG. 5, the present invention is shown in the context of an abdominal machine 86, which includes support frame 12 on which a user support structure 14 is mounted. The user support structure 14 includes a seat surface 16 and a pelvic stabilizer pad 18. The seat 16 is mounted on the forwardly facing angled upper portion of the support frame 12, below and at an angle oblique to the pelvic stabilizer pad 18. The seat 16 is positioned such that the user's lower back and pelvic region abuts the pelvic stabilizer pad 18 and the user's legs extend outwardly and downwardly. The pelvic stabilizer pad 18 is affixed to the upper end of the support frame 12, is inclined rearwardly, and is curved in a substantially half-cylindrical shape to accommodate for the user's lower back.

The adjustable footrest 20 is attached to the front of the support frame 12, where the oblique angle of the seat 16 substantially directs the seat down towards footrest 20. The footrest 20 is positioned so the user can apply a force using the leg muscles to push the pelvis into the pelvic stabilization pad 18. The footrest 20 can be adjusted back and forth with the footrest adjustment mechanism 22 to accommodate users of varying heights. When a user's feet are positioned on the footrest 20, the footrest is adjusted such that the users thighs are substantially parallel with the ground. Additionally, the user's knees are in a flexion position of between about 10 degrees knee flexion to about 30 degrees knee flexion. This spatial arrangement of the pelvic stabilizer pad 18, seat 16, and footrest 20 combination effectively immobilize the user's pelvic area, preventing it from rotating in either the anterior or posterior direction.

In the abdominal machine 86, the input assembly 12 includes a horizontal arm 88 fitted with handles 90, where the horizontal arm 88 and arm handles 90 are position directly in front of the user. The horizontal arm 88 pivots about a hinge 92 positioned substantially below the seat 16, such that handles 90 travel in a substantially linear path as the user pushes against the arm handles 90.

In a method of use, the user extends their arms until the elbows are fully extended. While keeping the elbows locked at zero degrees of flexion, the user will alternately flex the spine in a forward bending motion and extend the spine in a rearward bending motion. As such, the user's upper torso faces a substantially linear path of resistance, such that the body's abdominal muscles are effectively contracted and exercised. The user uses his arms to push the arm handles 90, and hence the path of resistance offered by the weight stack 42 flows directly through the user's hands, arms, and shoulders, and only then along the length of the torso. The user must then contract the entire length of his or her frontal abdominal wall. The stabilization assembly effectively locks the pelvis in one position essentially blocking the hip muscles from use during the exercise. This forces the abdominals to do all the work. To end the exercise, the user simple bends the elbows, removing the force exerted by the weight stack 42 on the user.

Alternatively, the user may grasp handle 90 with only one hand while still flexing and extending the spine in the forward and rearward direction, such that by pushing on the arm handles 90, the oblique abdominals may be exercised either on the left or right side of the torso.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A lower torso exercise machine for a user comprising:

a frame;

a user support structure mounted to the frame, the user support structure including a seat and a stationary pelvic stabilizing pad, the seat being mounted to the frame below and at an angle oblique to the pelvic stabilizing pad; and a footrest attached to the frame in front of the user support structure for pushing against by the user's feet, the footrest being adjustably positionable relative to the seat and the stabilizing pad such that the user can selectively adjust the force of the user's pushing against the footrest to enable the user to push the user's pelvis into the stabilizing pad to a degree that immobilizes the user's pelvis.

2. The lower torso exercise machine according to claim 1, wherein the oblique angle is such that the seat is directed towards the footrest.

3. The lower torso exercise machine according to claim 1, further comprising an input assembly engageable by a user; and a resistance mechanism operably connected to the input assembly.

4. The lower torso exercise machine according to claim 3, wherein the input assembly includes a padded member affixed to a horizontal arm, wherein the padded member is positioned substantially above the seat and engageable by a user's upper back.

5. The lower torso exercise machine according to claim 3, wherein the input assembly comprises a horizontal arm including a pair of arm handles, wherein the arm handles are positioned substantially above the seat and engageable by a user's hands, through the user's extend arms.

6. The lower torso exercise machine according to claim 5, wherein the horizontal arms moves in a substantially linear direction.

7. The lower torso exercise machine according to claim 3, where the resistance mechanism applies a resistive force through the users extended arms.

8. The lower torso exercise machine according to claim 3, wherein the input assembly is positioned substantially above and in front of the seat, such that the input assembly is engagable by a user's extended arms.

9. The lower torso exercise machine according to claim 3, further comprising a range-limiting device disposed between the input assembly and the frame, wherein the range-limiting device is pivotally connected to the frame and operatively connected to the resistance mechanism.

10. The lower torso exercise machine according to claim 1 wherein the stabilizing pad is semi-cylindrical in shape.

11. Method of performing a torso exercise by a user on an exercise machine having a frame comprising:

mounting a stabilization pad in a stationary position on the frame at a selected position;

disposing a seat on the frame at a horizontal position below the stabilization pad at an oblique angle to the stabilization pad;

seating the user on the seat;

adjustably positioning a footrest relative to the position of the seat such that the user can push on the footrest sufficiently to push the user's pelvis into contact with the stabilization pad;

pushing the user's feet against the footpad to a degree such that the user's pelvis is immobilized against the stabilization pad.

12. The method of claim 11 further comprising disposing an input assembly above the seat at a height manually engageable by the user, interconnecting the input assembly to a resistance mechanism and engaging the assembly by the user.

* * * * *

UNITED STATES PATENT AND TRADEMARK OFFICE

CERTIFICATE OF CORRECTION

PATENT NO. : 7,717,831 B2
APPLICATION NO. : 12/051976
DATED : May 18, 2010
INVENTOR(S) : Giannelli et al.

It is certified that error appears in the above-identified patent and that said Letters Patent is hereby corrected as shown below:

At col. 1, line 11, after "of" add -- which --.

At col. 3, line 20, delete "of".

At col. 6, line 27, change "extend" to -- extended --.

At col. 6, line 33, change "user" to -- user's --.

Signed and Sealed this

Seventeenth Day of August, 2010

David J. Kappos

David J. Kappos
*Director of the United States Patent and Trademark Office*